United States Patent [19]

Raasch

[11] Patent Number: 4,660,365

[45] Date of Patent: Apr. 28, 1987

[54] METHOD AND APPARATUS FOR DETERMINING YARN NUMBER OR THICKNESS DEVIATIONS

[75] Inventor: Hans Raasch, Monchen-Gladbach, Fed. Rep. of Germany

[73] Assignee: W. Schlafhorst & Co., Monchen-Gladbach, Fed. Rep. of Germany

[21] Appl. No.: 759,476

[22] Filed: Jul. 25, 1985

[30] Foreign Application Priority Data

Jul. 25, 1984 [DE] Fed. Rep. of Germany ..... 3427357

[51] Int. Cl.[4] ..... D01H 13/26; D01H 15/02

[52] U.S. Cl. ..... 57/263; 57/264

[58] Field of Search ..... 57/263, 264, 265; 73/160

[56] References Cited

U.S. PATENT DOCUMENTS

| | | | |
|---|---|---|---|
| 3,135,054 | 6/1964 | Martin | 57/265 X |
| 4,007,457 | 2/1977 | Aeppli | 57/264 |
| 4,137,699 | 2/1979 | Stahlecker et al. | 57/264 |
| 4,178,749 | 12/1979 | Stahlecker et al. | 57/263 |

FOREIGN PATENT DOCUMENTS

| | | | |
|---|---|---|---|
| 2944219 | 7/1980 | Fed. Rep. of Germany | 57/264 |
| 2950063 | 6/1981 | Fed. Rep. of Germany | 57/265 |
| 3005746 | 8/1981 | Fed. Rep. of Germany | 57/264 |
| 3237371 | 9/1983 | Fed. Rep. of Germany | 57/264 |

*Primary Examiner*—Billy S. Taylor
*Assistant Examiner*—Joseph J. Hail, III
*Attorney, Agent, or Firm*—Herbert L. Lerner; Laurence A. Greenberg

[57] ABSTRACT

A method for determining yarn number and thickness deviations for yarn connecting processes in automatic open-end spinning machines includes producing a yarn connection at a yarn connection point, subsequently automatically measuring one of the yarn number, yarn thickness and yarn mass per unit length in a yarn section of limited length upstream of the yarn connection point with the yarn running to produce a measured value, comparing the measured value with a comparison value, and inducing a signal with an indication regarding the spinning unit in the case of a deviation between the measured and comparison values with a predetermined magnitude, and an apparatus for carrying out the method.

11 Claims, 1 Drawing Figure

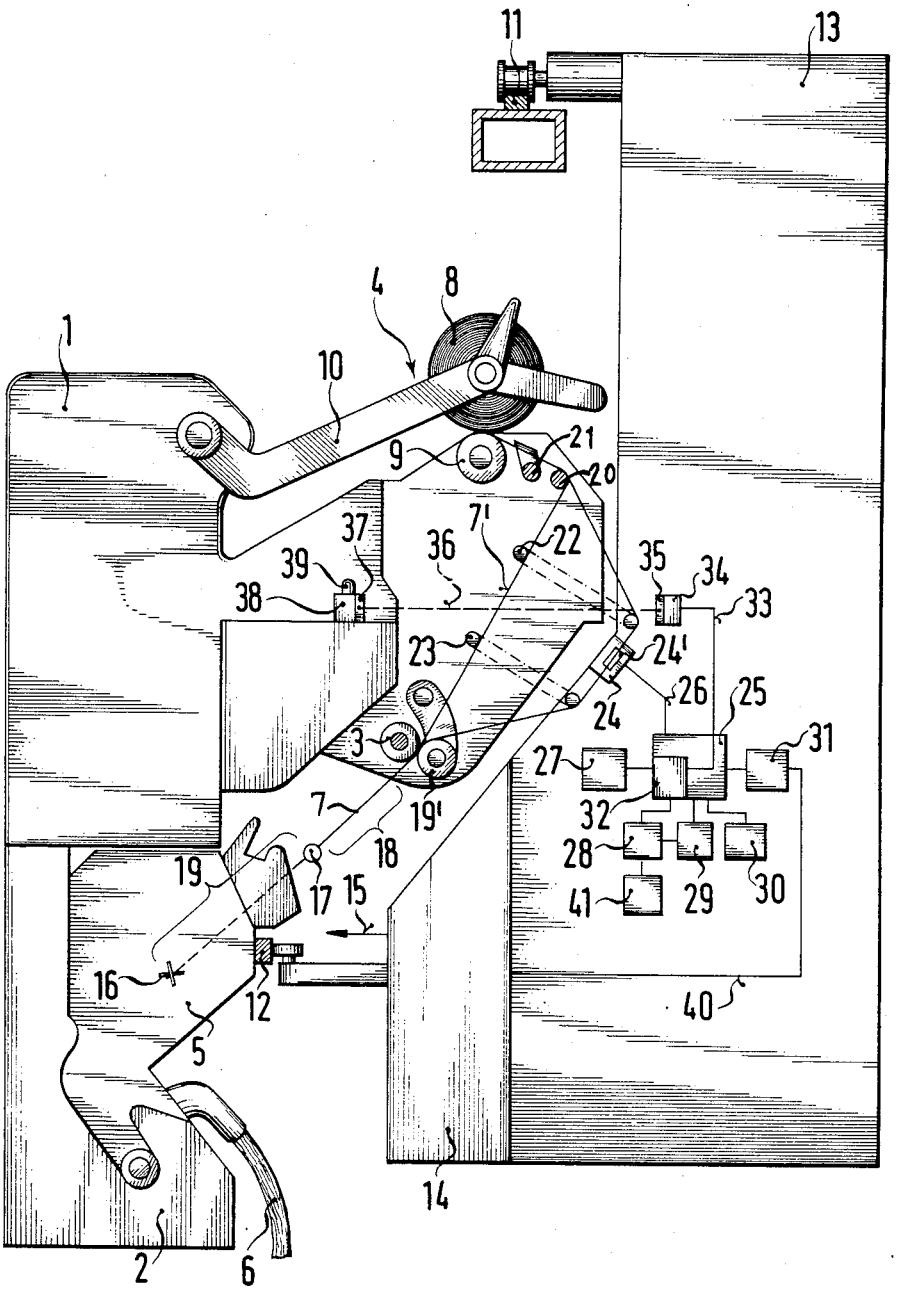
11
13
4
8
1
10
9
21
20
7'
22
37
36
39
38
35
34
33
23
24'
26
25
24
3
31
27
19'
32
7
18
28
19
17
15
29
30
41
16
12
40
5
14
2
6

METHOD AND APPARATUS FOR DETERMINING YARN NUMBER OR THICKNESS DEVIATIONS

BACKGROUND OF THE INVENTION

1. Field of the Invention

The invention relates to a method and apparatus for determining yarn number or thickness deviations in yarn connecting processes of automatic open-end spinning machines.

2. Description of the Related Art

As is known, yarn connections are always necessary in automatic open-end spinning machines when the thread breaks, has to be cut due to faulty formation, or if the sliver supply runs out and new sliver must be inserted.

Although as a rule the yarn splicing region itself is monitored, in order to make certain that no yarn connections of unacceptable dimensions, strength, or poor appearance are in the yarn, it must be assured that there is no possibility for other less conspicuous yarn number or thickness deviations to remain undetected.

It is also possible for a slight yet permanent change in the yarn number or the yarn thickness to occur and remain undetected due to its small magnitude, when introducing new sliver. The above-mentioned yarn number or thickness deviations dealt with in this case are not visible with the naked eye. They will only become visible, if at all, in the finished fabric subsequently made from this yarn.

SUMMARY OF THE INVENTION

It is accordingly an object of the invention to provide a method and apparatus for determining yarn number or thickness deviations, which overcome the hereinaforementioned disadvantages of the heretoforeknown methods and devices of this general type, and to determine, detect, and indicate possible deviations of the yarn number or thickness which cannot be detected with the naked eye in yarn connection processes of automatic open-end spinning machines.

With the foregoing and other objects in view there is provided, in accordance with the invention, a method of determining yarn number or thickness deviations for yarn connecting processes in automatic open-end spinning machines, which comprises producing a yarn connection at a yarn connection point, subsequently automatically measuring one of the yarn numbers or gauge, yarn thickness or yarn mass or bulk per unit length in a yarn section of limited length upstream of the yarn connection point with the yarn running to produce a measured value, comparing the measured value with a comparison value, and inducing or generating a signal with an indication regarding the spinning unit or location in the case of a deviation between the measured and comparison values with a predetermined magnitude.

As an alternative, there is provided a method of determining yarn number or thickness deviations for yarn connecting processes in automatic open-end spinning machines, which comprises producing a yarn connection at a yarn connection point, subsequently automatically measuring one of the yarn number or gauge, yarn thickness or yarn mass or bulk per unit length in yarn sections of limited length upstream and downstream of the yarn connection point with the yarn running to produce measured values, comparing the measured values with each other, and inducing or generating a signal with an indication regarding the spinning unit or location in the case of a deviation between the measured and comparison values with a predetermined magnitude.

The magnitude of the number, yarn mass or yarn thickness deviation determines whether the spinning station is kept in operation or not. The continued operation of the spinning station also depends on whether the number, yarn mass or yarn thickness deviation is permanent or not. Due to the automatic measurement with the yarn running, there is no time loss and also no production loss. Since unacceptable yarn number or thickness deviations in connection with yarn joining processes are to be considered as exceptions, the invention is mainly intended as a provision for ensuring quality. Through the use of the invention, it becomes possible to guarantee that the spool of yarn produced in an open-end spinning machine contains no deviations of yarn number or yarn thickness generated in yarn connection processes, which went undetected heretofore.

Since the yarn number, yarn thickness, or yarn mass of the spun yarn fluctuate due to the very nature of the process, such fluctuations can influence, disturb and falsify the result of measurements. For this reason, in accordance with another mode of the invention the method comprises sequentially forming mean or average values from the individual measured values, determining one of the mean yarn number, yarn thickness and yarn mass per unit length for the yarn section downstream of the yarn connection point, and subsequently determining one of the mean yarn number, yarn thickness or yarn mass per unit length for the yarn section upstream of the yarn connection point.

The formation of the mean value eliminates the natural fluctuations of the yarn number, yarn cross section, or yarn thickness, and the successive measurement simplifies the automation, because the measurements can be made at one fixed measuring location through which the yarn is conducted.

In accordance with a further mode of the invention, there is provided a method which comprises measuring the yarn number, yarn thickness and yarn mass per unit length in the yarn sections at least 300 mm downstream and at most 4 m upstream of the yarn connection point. This is done because it has been established that the number or thickness deviations are more pronounced in vicinity of the yarn connection region than at other yarn sections. This ensures that yarn irregularities can be reliably detected in the shortest time. It is advantageous to use measurements which were made in other spinning regions as comparison values.

To make this possible, in accordance with an added mode of the invention there is provided a method which comprises measuring the yarn number, yarn thickness and yarn mass per unit length at a predetermined number of spinning units or locations to produce a mean or measured value or values, producing mean or average comparison values from the measured value or values, continuously correcting the comparison values by deleting the measured value of the first spinning unit when including the measured value of the last spinning unit or location in the average value production, so that the average value production always extends to a predetermined number of spinning units or locations measured last. In this way, the comparison values are automatically and continuously corrected.

In order to carry out the method, there is provided an apparatus for determining yarn number or thickness deviations for yarn connecting processes in automatic open-end spinning machines, comprising a measuring device or meter for measuring at least one of yarn number, yarn thickness or yarn mass or bulk and producing a measured value, the measuring device including at least one measuring point disposed downstream of a yarn connection point at which the measurements are taken, the measuring device including a measuring value comparator for comparing the measured value with a comparison value, and including a measuring value difference indicator for indicating differences between the measured value and the comparison value, and an operative connection connected between the measuring value comparator and the measuring value difference indicator.

In accordance with another feature of the invention, the measuring device performs measurements and produces measured values at yarn sections disposed upstream and downstream of the yarn connection point, and the measuring value comparator compares the measured values.

If only one measuring location is provided, the yarn section before the yarn connection point passes the measuring location first, then the yarn connection point follows, and finally the yarn section behind the yarn connection point passes. The yarn number or yarn thickness is determined sequentially in time. However, if two measuring places are provided, the yarn section disposed before the connection point passes one measuring location while the yarn section behind the connection point simultaneously passes the second measuring location. Thus, measurements can be made simultaneously at the two measuring locations. Each can be provided with its own yarn number or yarn thickness measuring device. The use of only a single yarn number or yarn thickness measuring device is more economical, because the measuring time with the yarn running is quite short. Two measuring positions permit the simultaneous acquisition of the measured values before and after the thread connection point, so that the result of the measurement and the difference between the measured values can be determined even faster.

In accordance with a further feature of the invention, the measuring device includes a measuring value storage device or memory. A storage device is advantageous at least in all cases where the measured values are obtained successively in time intervals.

In accordance with an added feature of the invention, the measuring device includes a mean value former for forming mean values of a plurality of individual, sequential measurements. The advantages of forming the mean values were already mentioned above.

In accordance with an additional feature of the invention, there is provided a device connected to the mean value former for selecting a limited number of individual measurements upstream and downstream of the thread connection point for forming mean values. For instance, if ten individual measurements are provided for forming the average, it is possible to begin to form the average value at an early point in time, when the yarn connection point has not yet passed the measuring location. During the eleventh individual measurement, the first individual measurement is deleted from the production of the average value, at the twelfth individual measurement the second measurement is deleted and so on, until the yarn connection point reaches the measuring location. The yarn connection point itself is not included in the formation of the average value. As soon as the yarn connection point has left the measuring location, the formation of average values from individual measurements is resumed, and a predetermined number of individual measurements can be used for producing the average value, which can now be many more than ten individual measurements.

In accordance with again another feature of the invention, there is provided a selection device connected to the mean value former for selecting the mean or measuring values of the yarn number, yarn thickness or yarn mass per unit length measured at a predetermined number of spinning units and for producing a mean comparison value, the selection device including means for deleting the measuring value of a first spinning unit when the measuring value of a last spinning unit is added, so that a mean value is produced which always extends to a predetermined number of spinning units or positions measured last.

Since the yarn number, mass or thickness of the yarn connection point is also of interest, the yarn connection point can be measured in the same location. For this purpose, in accordance with again a further feature of the invention, the measuring device includes a second evaluation channel for measuring the thickness of the yarn connection point.

As a rule, automatic open-end spinning machines are provided with servicing devices for automatically starting the spinning process, for cleaning the spinning apparatus and for changing bobbins. In order to add a new, additional use to such servicing devices, in accordance with again an added feature of the invention, there is provided a movable servicing device, at least the measuring point of the measuring device being disposed on the servicing device.

In accordance with a concomitant feature of the invention, the yarn runs in a given normal position, and including a guide element disposed in vicinity of the measuring point for guiding the yarn from the given normal position to the measuring point and back again.

For instance, if the measuring location is located on a servicing device which handles the starting of the spinning or thread joining, guide elements are already provided, which conduct the yarn from the normal running position to the servicing device. These pre-existing guide elements can be utilized for guiding the yarn through or past the measuring location.

Other features which are considered as characteristic for the invention are set forth in the appended claims.

Although the invention is illustrated and described herein as embodied in a method and apparatus for determining yarn number or thickness deviations, it is nevertheless not intended to be limited to the details shown, since various modifications and structural changes may be made therein without departing from the spirit of the invention and within the scope and range of euivalents of the claims.

BRIEF DESCRIPTION OF THE DRAWINGS

The construction and method of operation of the invention, however, together with additional objects and advantages thereof will be best understood from the following description of specific embodiments when read in connection with the single figure of the drawing which is a diagrammatic, side-elevational view of the apparatus according to the invention.

DESCRIPTION OF THE PREFERRED EMBODIMENTS

Referring now to the single figure of the drawing in detail, there is seen an open-end spinning machine 1 which includes a great number of individual spinning devices 2, yarn or thread withdrawal devices 3, and spooling or winding devices 4. Each spinning device 2 has a spinning box 5 which can be swung open. Sliver 6 is introduced into the spinning box 5 and spun to form yarn 7. The yarn 7 is wound onto a spool 8, which lies on a rotating drive roller 9 and is held by a pivotable spool frame 10.

A servicing device 13 can travel along the open-end spinning machine on rails 11, and is provided with an automatic spinning-starting or thread-joining device 14. The device 14 can act on the spinning box 5 in the direction of an arrow 15 in a manner which is not further shown or described. This is done in order to produce a thread connection in the form of a spinning start or thread joint with evenness of the yarn, after a thread-break or after the sliver supply runs out. A location 16 where the thread is joined or started lies in the interior of the spinning box 5 and is marked by an X. The splice 17 itself is indicated in a very exaggerated way.

It is assumed that the spinning-starting or thread-joining device 14 has just produced a thread connection. Downstream of the splice 17 is a yarn section 18 which is about 400 mm long. Upstream of the splice 17 is a yarn section 19, which will have a length of 4 m later.

The normal running position of the yarn 7 is designated with reference numeral 7'. The yarn therefore runs under a pressure roller 19' of the yarn withdrawal device 3, is deflected at a guide rod 20, passes through a reciprocating thread guide 21, and reaches the spool 8 from the bottom.

However, the path of the thread is changed after the yarn connection 17 has been made. Two pivotable guide elements 22, 23 provided at the servicing device 13, move the thread out of its normal position and conduct it to a measuring point 24 of a yarn thickness meter or measuring device 25. The measuring point 24 is connected with the yarn thickness meter 25 by an electric line 26. The thickness meter 25 and a measuring element 24' of the measuring point 24 are in continuous readiness to operate, and begin with a continuous series of individual measurements at the moment the yarn 7 runs over the measuring point 24. The thickness meter 25 is provided with a measured value storage device 27 for storing measuring results. Furthermore, the meter 25 has a mean value former 28 for forming the arithmetic average or mean value of several sequential individual measurements and for forming the average or mean value of the measured values obtained at a defined number of the spinning units or points measured last. In turn, the mean value former 28 is connected with a device 29 for the selection of a limited number of individual measurements positioned upstream or downstream of the splice or thread connection point 17, which are used for forming the average or mean value. The mean value former 28 is also connected with a device 41. The device 41 serves for selecting the measured values or average or mean values of the yarn thickness, which were measured at a defined number of spinning units, for measuring the mean or average values for comparison. The device 41 is constructed in such a way that as the last measured spinning unit or point is included among the selected values, the measured value of the respective spinning unit or point measured first drops out, so that the average value obtained always represents a defined number of spinning units or points measured last. Furthermore, the yarn thickness meter 25 has an adjustment device 30, which serves especially for setting the number of individual measurements from which the average or mean values or comparison values are to be formed. Additionally, the yarn thickness meter 25 has a second evaluation channel 31 for measuring the thickness of the splice or yarn connection point 17.

This evaluation channel 31 responds only to very sudden thickness changes, and therefore only measures a yarn connection point 17 if its thickness clearly noticeably deviates from nominal values. The yarn thickness meter 25 is provided with a measured value comparator 32, which selectively compares the average or mean values of the measured values with each other, or with comparison values, and has a functional or operative connection 33 to a measurement value difference indicator 34, which is equipped with an optical transmitter 35. The optical transmitter 35 sends a light beam 36 to the receiver 37 of an opto-electrical device 38 as soon as the average or mean values deviate a few percent from each other, or from comparison values. In this case, the opto-electrical device 38 causes an indicator lamp 39 to light up.

If no comparison values are available, or they are not to be used, the procedure is as follows:

Although the yarn thickness meter 25 starts its measurement quite early, only the yarn section 18 is of interest for forming the average or mean value. It is assumed that with the aid of the adjustment device 30, ten individual measurements are set for forming the average or mean value for the yarn section downstream of the splice or connection point 17. In this case, the device 29 ensures that upon the occurrence of the eleventh individual measurement, the first measurement is dropped from the value formed, after the twelfth individual measurement, the second measurement is dropped out and so on, until the splice or yarn connection point 17 reaches the measuring point 24. The last average value which is now determined is stored in the measured value storage device 27. After the splice or thread connection point 17 has left the measuring point 24, the individual measurements are resumed and stored in the measured value storage device 27, then the average value is formed from the predetermined number of measurements with the help of the mean value former 28, and thereafter the measuring value comparator 32 compares the two average or mean values with each other. If the average values deviate from each other by more than 1%, for example by 8%, the average value comparator 32 sends a signal through the functional connection 33 to the measured value difference indicator 34, which thereafter causes the opto-electrical device 38 to turn on the indicator lamp 39.

If the yarn connection point 17 has a thickness greater than its nominal or desired value, the moment this splice 17 runs past the measuring point 24, the second evaluation channel 31 responds over a functional or operative connection 40 causing the separation of the thread connection by the spinning-starting or thread-joining device 14, and initiates a renewed start of the spinning operation or joining of the thread.

Thus, in the illustrated embodiment, a yarn connection point of abnormal size leads to a repetition of the start of spinning or thread joining, while a deviation of the yarn number or a deviation of the yarn thickness of a normal size only causes an optical signal, but does not stop the spinning device. The reason for this is that the number deviation or thickness deviation relates to the short piece of thread at both sides of the thread connection or joint 17. However, after the error signal has been given, the thickness or yarn number can be measured again for control purposes and if the measured value difference continues, the spinning device 2 can be stopped. In any case, the lighting of the indicator lamp 39 gives notice that a thickness or yarn number deviation existed, if only for a short time.

It is therefore possible to investigate for the causes of such deviations in the spinning device or in the servicing apparatus, in order to eliminate these deviations. Obviously it is also possible upon the occurrence of value deviations, to either immediately repeat the starting of the spinning operation or thread joining, or to take the spinning station out of operation. For this reason, the functional connection 33 must lead to the spinning-starting or thread-joining device 14. The spinning-starting or thread-joining device 14 is able to take the spinning station out of operation after repeated unsuccessful attempts at starting the spinning or thread-joining operation.

Before the servicing device 13 can travel to another spinning station, the two guide elements 22 and 23 swing back to their starting positions, to bring the yarn 7 back to its normal running position 7'. Then the guide elements swing back to the rear, so that they do not obstruct the further travel of the servicing unit 13.

Comparison values for later measurements are obtained in the following way:

Mean or average values of the yarn thickness at the initially measured spinning point or unit are stored in the measuring value storage device or memory 27. Similarly, the mean or average values of the yarn thickness of the later measured spinning points or units are stored. The mean value former 28 forms a comparison value from these mean values, which is continuously corrected in the following way:

First, the amount of spinning points or units that will be used for forming the comparison values from the measurements, is set. The comparison values are taken at ten spinning points or units.

When including the last measured spinning point or unit in the average value calculation, the first measured value is taken out of the average value calculation, so that the average obtained always relates to a predetermined number of places which were measured last.

When the comparison values are given or were obtained as described above and are being used, the yarn thickness of the thread section 19 which is disposed upstream of the connection point, is compared with these comparison values or average comparison values, and in the case of thickness deviations of a certain magnitude, the indicator lamp 39 lights up.

The invention is not limited to the described and illustrated embodiment which was used as an example.

I claim:

1. Method of determining yarn number and thickness deviations for yarn connecting processes in automatic openend spinning machines, which comprises producing a yarn connection at a yarn connection point, subsequently automatically measuring one of the yarn number, yarn thickness and yarn mass per unit length in a yarn section of limited length upstream of the yarn connection point at a predetermined number of spinning units with the yarn running to produce a measured value, comparing the measured value with a comparison value, producing mean comparison values from the measured value, continuously correcting the comparison values by deleting the measured value of the first spinning unit when including the measured value of the last spinning unit in the average value production, so that the average value production always extends to a predetermined number of spinning units measured last, and inducing a signal with an indication regarding the spinning unit in the case of a deviation between the measured and comparison values with a predetermined magnitude.

2. Method of determining yarn number and thickness deviations for yarn connecting processes in automatic openend spinning machines, which comprises producing a yarn connection at a yarn connection point, subsequently automatically measuring one of the yarn number, yarn thickness and yarn mass per unit length in yarn sections of limited length upstream and downstream of the yarn connection point at a predetermined number of spinning units with the yarn running to produce measured values, comparing the measured value with each other, producing mean comparison values form the measured values, continuously correcting the comparison values by deleting the measured value of the first spinning unit when including the measured value of the last spinning unit in the average value production, so that the average value production always extends to a predetermined number of spinning units measured last, and inducing a signal with an indication regarding the spinning unit in the case of a deviation between the measured and comparison values with a predetermined magnitude.

3. Method according to claim 2, which comprises sequentially forming mean values from the individual measured values, determining one of the mean yarn number, yarn thickness and yarn mass per unit length for the yarn section downstream of the yarn connection point, and subsequently determining one of the mean yarn number, yarn thickness and yarn mass per unit length for the yarn section upstream of the yarn connection point.

4. Method according to claim 2, which comprises measuring the yarn number, yarn thickness and yarn mass per unit length in the yarn sections at least 300 mm downstream and at most 4 m upstream of the yarn connection point.

5. Method according to claim 1, which comprises measuring the yarn number, yarn thickness and yarn mass per unit length in the yarn section at most 4 m upstream of the yarn connection point.

6. Apparatus for determining yarn number and thickness deviations for yarn connecting processes in automatic open-end spinning machines, comprising a measuring device for measuring at least one of yarn number, yarn thickness and yarn mass and producing measured values, said measuring device including measuring points disposed upstream and downstream of a yarn connection point at which the measurements are taken for performing measurements and producing measured values at yarn sections disposed upstream and downstream of said yarn connection point, said measuring device including a measuring value comparator for comparing the measured values with a comparison value, a mean value former for forming mean values of a plurality of individual, sequential measurements, and a selection device connected to said mean value former for selecting the measuring values measured at a predetermined number of spinning units and for producing a mean comparison value, said selection device including means for deleting the measuring value of a first spinning unit when the measuring value of a last spinning unit is added, so that mean value is produced which always extends to a predetermined number of spinning units measured last, and including a measuring value difference indicator for indicating differences between the measured value and the comparison value, and an operative connection connected between said measuring value comparator and said measuring value difference indicator.

7. Apparatus according to claim 6, wherein said measuring device includes a measuring value storage device.

8. Apparatus according to claim 6, including a device connected to said mean value former for selecting a limited number of individual measurements upstream and downstream of the thread connection point for forming mean values.

9. Apparatus according to claim 6, wherein said measuring device includes an evaluation channel for measuring the thickness of the yarn connection point.

10. Apparatus according to claim 6, including a movable servicing device, at least said measuring point of said measuring device being disposed on said servicing device.

11. Apparatus according to claim 6, wherein the yarn runs in a given normal position, and including a guide element disposed in vicinity of said measuring point for guiding the yarn from the given normal position to said measuring point and back again.

* * * * *